US011890527B1

(12) United States Patent
De La Rua et al.

(10) Patent No.: US 11,890,527 B1
(45) Date of Patent: Feb. 6, 2024

(54) LATCHING FENDER FOR ELECTRIC VEHICLE

(71) Applicant: Future Motion, Inc., Santa Cruz, CA (US)

(72) Inventors: Julian De La Rua, Santa Cruz, CA (US); Daniel Blachinsky, Squamish (CA); Kyle Jonathan Doerksen, Santa Cruz, CA (US); Phil Rullman, Flagstaff, AZ (US)

(73) Assignee: FUTURE MOTION, INC., Santa Cruz, CA (US)

( * ) Notice: Subject to any disclaimer, the term of this patent is extended or adjusted under 35 U.S.C. 154(b) by 0 days.

(21) Appl. No.: 18/342,934

(22) Filed: Jun. 28, 2023

(51) Int. Cl.

| | |
|---|---|
| ***B62J 15/04*** | (2006.01) |
| ***A63C 17/00*** | (2006.01) |
| ***A63C 17/08*** | (2006.01) |

(52) U.S. Cl.
CPC ..... *A63C 17/002* (2013.01); *A63C 17/08* (2013.01)

(58) Field of Classification Search
CPC ..... A63C 17/12; A63C 17/08; A63C 17/002
See application file for complete search history.

(56) References Cited

U.S. PATENT DOCUMENTS

| | | | | |
|---|---|---|---|---|
| 2,157,793 | A * | 5/1939 | Lang | B62D 25/184 280/848 |
| 2,868,310 | A * | 1/1959 | Lee | B62D 25/168 180/69.2 |
| 4,106,786 | A * | 8/1978 | Talbott | A63C 17/01 280/8 |
| 4,339,016 | A * | 7/1982 | Gerresheim | B62D 25/168 280/847 |
| 5,984,037 | A * | 11/1999 | Duhem | B62D 25/184 180/69.2 |
| 9,308,944 | B2 * | 4/2016 | Hanson | B60Q 1/0408 |
| D843,532 | S | 3/2019 | Doerksen | |
| 10,456,658 | B1 | 10/2019 | Doerksen et al. | |
| 2018/0161661 | A1 * | 6/2018 | Ma | A63C 17/1418 |
| 2018/0346049 | A1 * | 12/2018 | Eitel | B62D 25/184 |
| 2021/0205692 | A1 * | 7/2021 | Fagerberg | A63C 17/12 |

* cited by examiner

*Primary Examiner* — Brian L Swenson
(74) *Attorney, Agent, or Firm* — Kolitch Romano Dascenzo Gates LLC

(57) ABSTRACT

Fender assemblies are disclosed, each assembly including a frame and a fender. The frame has a first leg including a first coupling portion and a second leg including a first latch portion, and the frame is configured to be coupled to the vehicle with the first leg and the second leg on opposite sides of a wheel. The fender has a first end and a second end, the first end having a second coupling portion configured to releasably mate with the first coupling portion of the frame to form a manually releasable joint, the second end comprising a second latch portion configured to mate with the first latch portion of the frame to releasably secure the second end to the frame.

20 Claims, 9 Drawing Sheets

LATCHING FENDER FOR ELECTRIC VEHICLE

CROSS-REFERENCES

The following applications and materials are incorporated herein, in their entireties, for all purposes: U.S. Pat. No. 10,456,658, granted Oct. 29, 2019.

FIELD

This disclosure relates to fenders for electric vehicles. More specifically, the disclosed embodiments relate to fender assemblies for one-wheeled, self-stabilizing skateboards.

SUMMARY

The present disclosure provides systems, apparatuses, and methods relating to an improved fender assembly for a one-wheeled skateboard or similar vehicle.

In some examples, a fender assembly for a wheeled vehicle includes: a base frame comprising a first leg including a first hinge portion and a second leg including a first latch portion, wherein the base frame is configured to be coupled to a vehicle with the first leg and the second leg on opposite sides of a wheel of the vehicle; and a fender including a first end and a second end, the first end having a second hinge portion configured to releasably mate with the first hinge portion of the frame to form a pivoting joint, the second end comprising a second latch portion configured to mate with the first latch portion of the frame to releasably secure the second end to the frame.

In some examples, a fender assembly for a wheeled vehicle includes: a frame comprising a first leg including a first coupling portion and a second leg including a first latch portion, wherein the frame is configured to be coupled to the vehicle with the first leg and the second leg on opposite sides of a wheel; and a fender including a first end and a second end, the first end having a second coupling portion configured to releasably mate with the first coupling portion of the frame to form a manually releasable joint, the second end comprising a second latch portion configured to mate with the first latch portion of the frame to releasably secure the second end to the frame.

Features, functions, and advantages may be achieved independently in various embodiments of the present disclosure, or may be combined in yet other embodiments, further details of which can be seen with reference to the following description and drawings.

DETAILED DESCRIPTION

Figure 1:
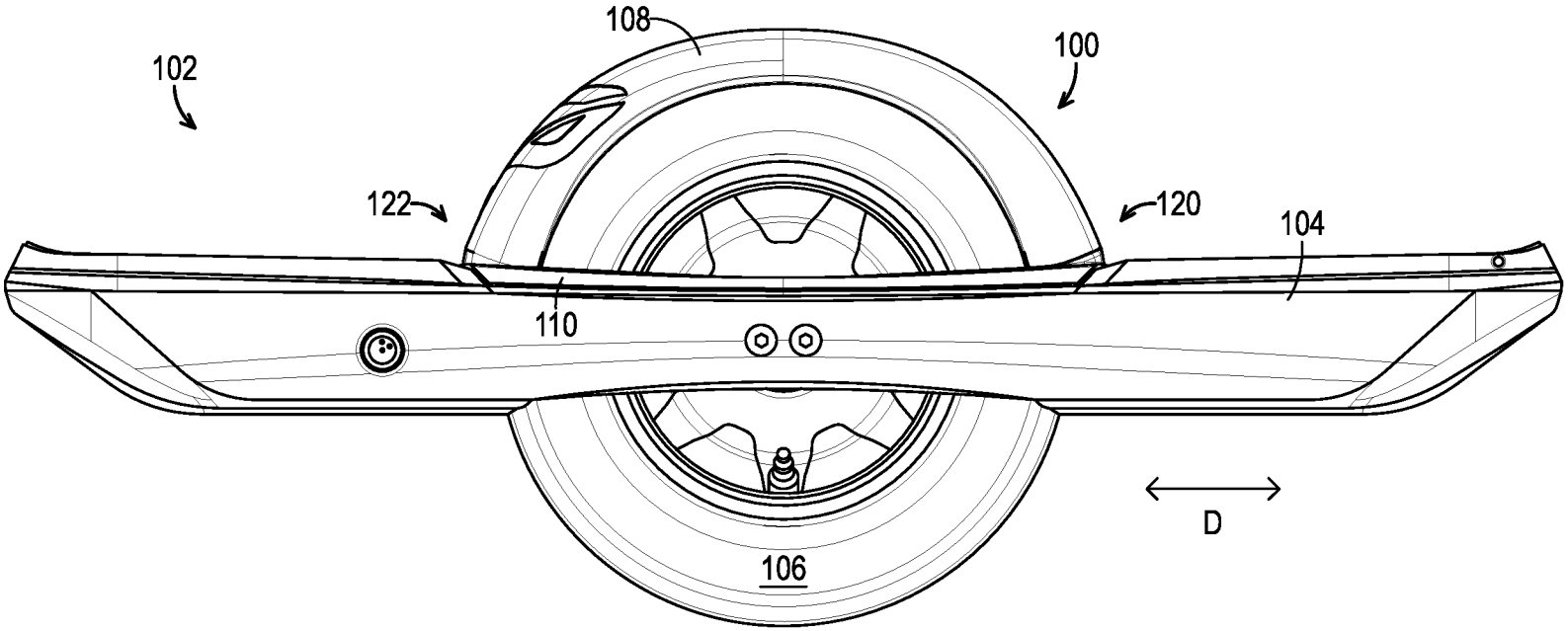
FIG. 1 is a side view of an illustrative one-wheeled electric skateboard having a fender assembly in accordance with aspects of the present disclosure.
Figure 2:
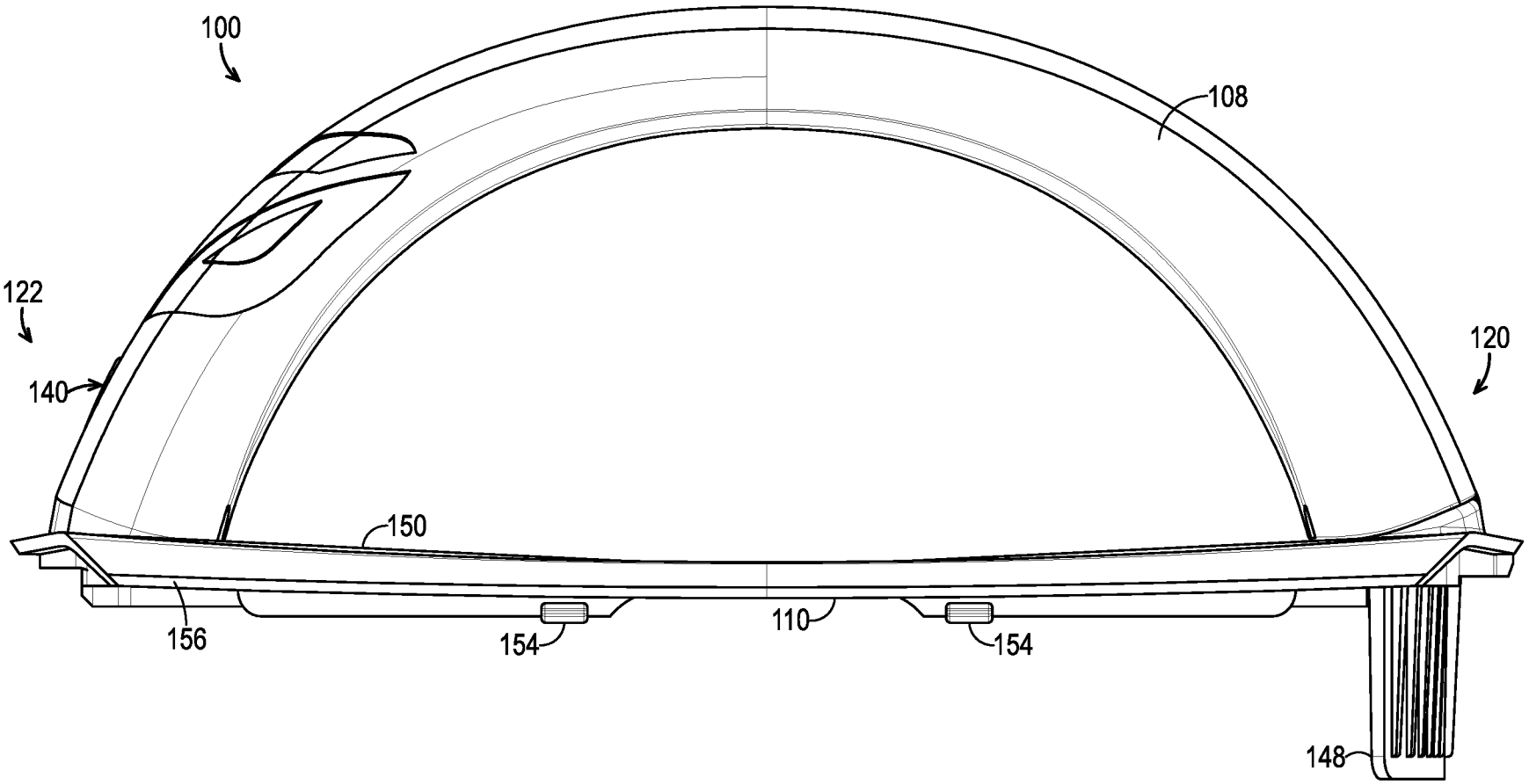
FIG. 2 is a side view of an illustrative fender assembly according to the present teachings.
Figure 3:
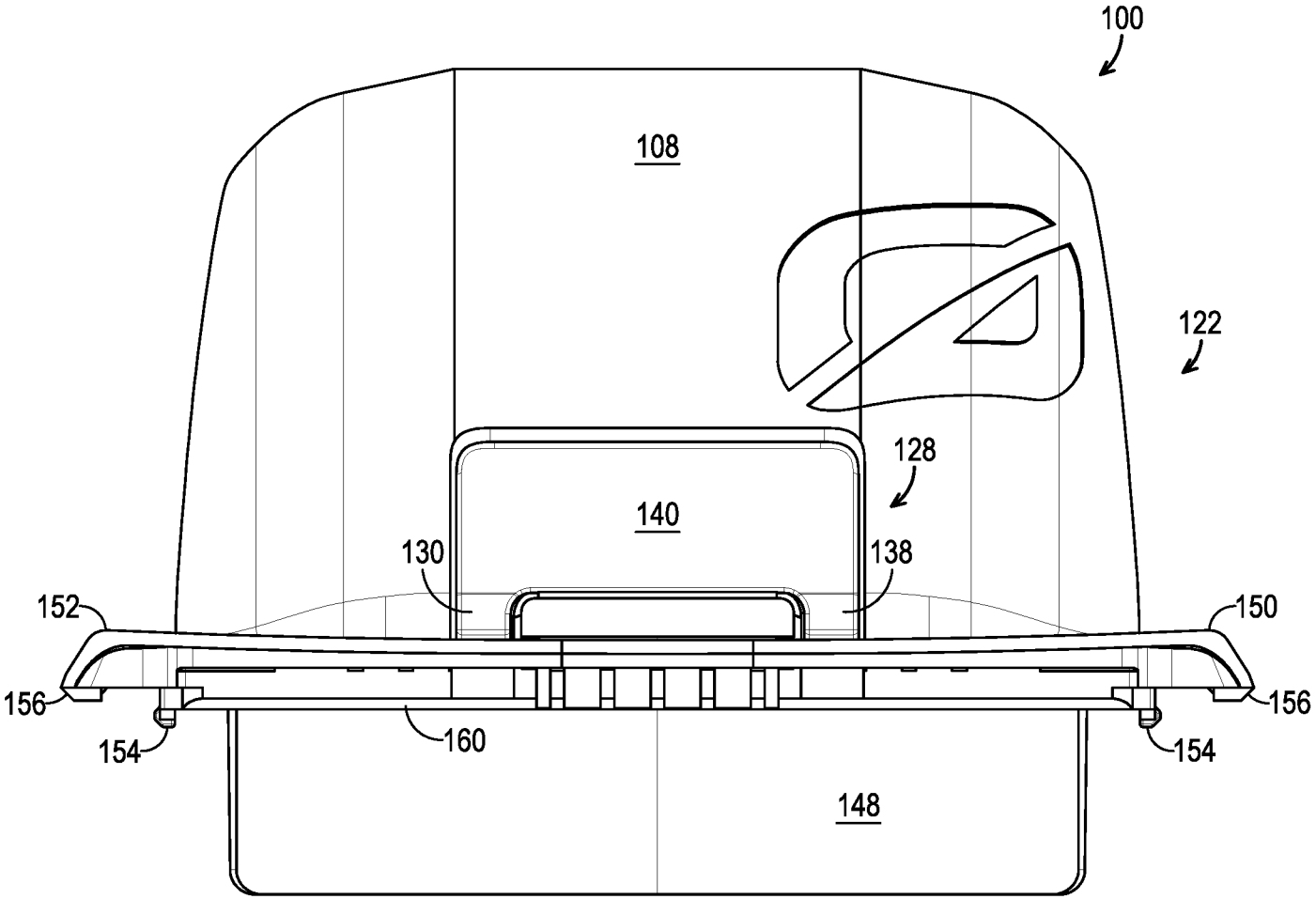
FIG. 3 is an end view of the fender assembly of FIG. 2.

Various aspects and examples of a fender assembly for use with one-wheeled skateboards (and similar vehicles), as well as related methods, are described below and illustrated in the associated drawings. Unless otherwise specified, a fender assembly in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

The terms "inboard," "outboard," "forward," "rearward," and the like are intended to be understood in the context of a host vehicle on which systems described herein may be mounted or otherwise attached. For example, "outboard"

may indicate a relative position that is laterally farther from the longitudinal centerline of the vehicle, or a direction that is away from the vehicle centerline. Conversely, "inboard" may indicate a direction toward the centerline, or a relative position that is closer to the centerline. Similarly, "forward" means toward the front portion of the vehicle, and "rearward" means toward the rear of the vehicle. In the absence of a host vehicle, the same directional terms may be used as if the vehicle were present. For example, even when viewed in isolation, a device may have a "forward" edge, based on the fact that the device would be installed with the edge in question facing in the direction of the front portion of the host vehicle.

The terms "longitudinally" and "laterally" (and the like) are intended to be understood such that the lateral direction is generally parallel to the axis of rotation of the wheel and the longitudinal direction is generally parallel to the vehicle's direction of travel.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, a fender assembly in accordance with the present teachings may include multiple elements coupled together, such that the assembly is removably attachable to a one-wheeled skateboard (or similar vehicle) and such that an arched fender of the assembly is pivotable and/or detachable with respect to a base or "fender delete" portion. Examples of suitable one-wheeled vehicles are disclosed in U.S. Pat. No. 10,456,658.

The latchable and pivotable fender arch of the present disclosure has a latching end and a hinged end, such that the latching end of the arch can be selectively raised and lowered like the hood or bonnet of a car. This facilitates easy access to the underlying tire while ensuring the arch of the fender remains securely fastened to the vehicle during normal use (e.g., riding). The removable nature of the pivotable fender arch facilitates a user switching between operating the vehicle with a covered wheel and operating the vehicle with an uncovered wheel. For example, the user can remove the fender arch by hand (without tools), by unlatching one end and manually detaching the other, rather than needing to remove fasteners to detach a full fender from the vehicle and then refasten a separate fender delete.

Examples, Components, and Alternatives

The following sections describe selected aspects of illustrative fender assemblies, as well as related systems and/or methods. The examples in these sections are intended for illustration and should not be interpreted as limiting the scope of the present disclosure. Each section may include one or more distinct embodiments or examples, and/or contextual or related information, function, and/or structure.

I. Illustrative Fender Assembly

As shown in FIGS. 1-10, the following section describes selected aspects of illustrative fender assemblies, as well as related systems and/or methods. The examples below are intended for illustration and should not be interpreted as limiting the scope of the present disclosure.

FIG. 1 depicts an illustrative fender assembly 100 installed on an example of a one-wheeled vehicle 102. As depicted in FIG. 1, the fender assembly is coupled to a body 104 (AKA vehicle frame) of the vehicle, and is configured to prevent mud and other debris leaving a wheel or tire 106 from reaching the rider and/or any nearby persons or objects.

Fender assembly 100 includes two portions: a detachable fender 108 and a base frame 110. The fender may be referred to as a fender portion or fender arch. The base frame may be referred to as a frame. In some examples, the base frame may be referred to as a ring or an annulus or a fender delete.

Figure 4:
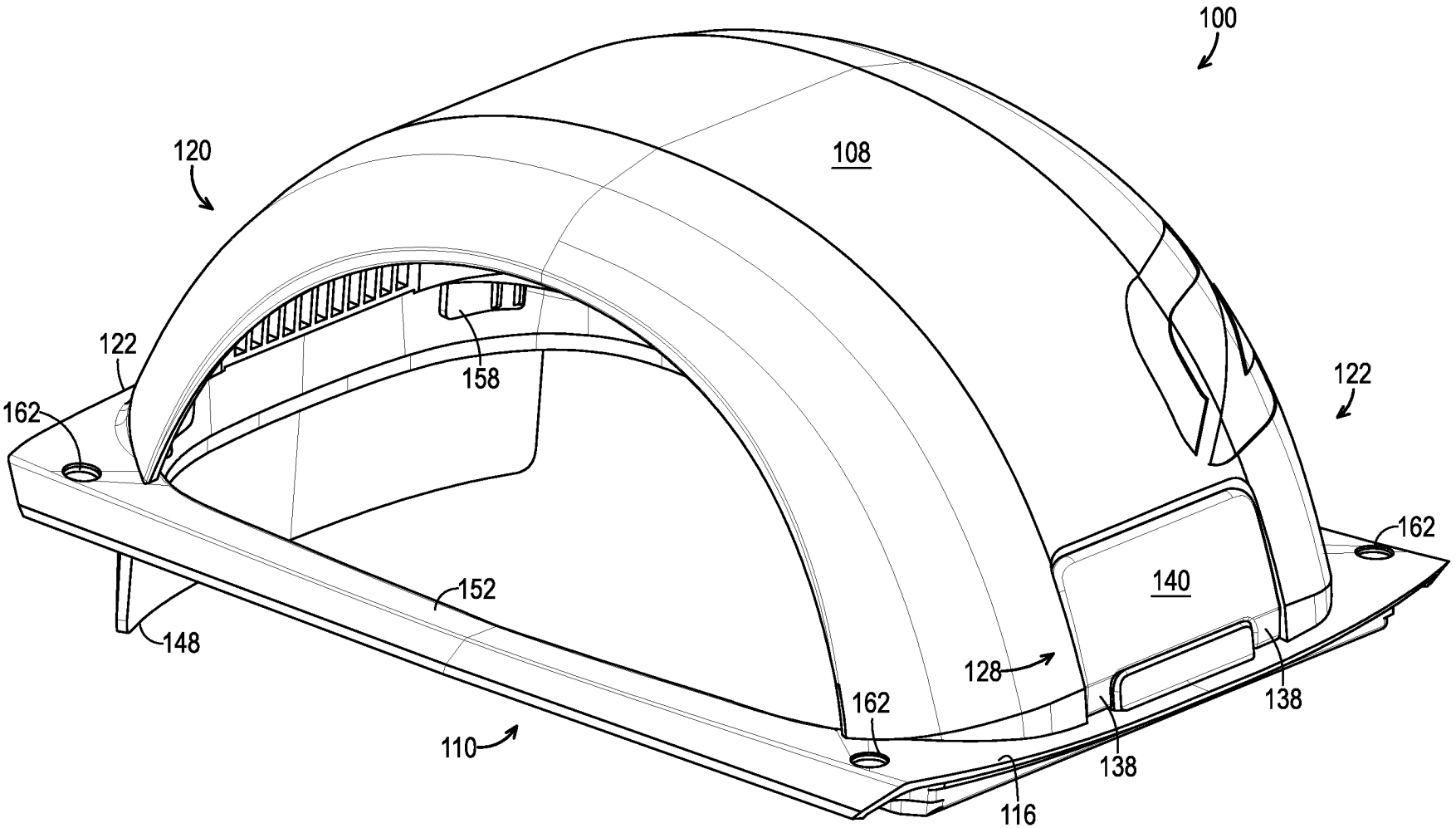
FIG. 4 is an isometric oblique view of the fender assembly of FIG. 2 in a closed configuration, taken from a latching end.
Figure 5:
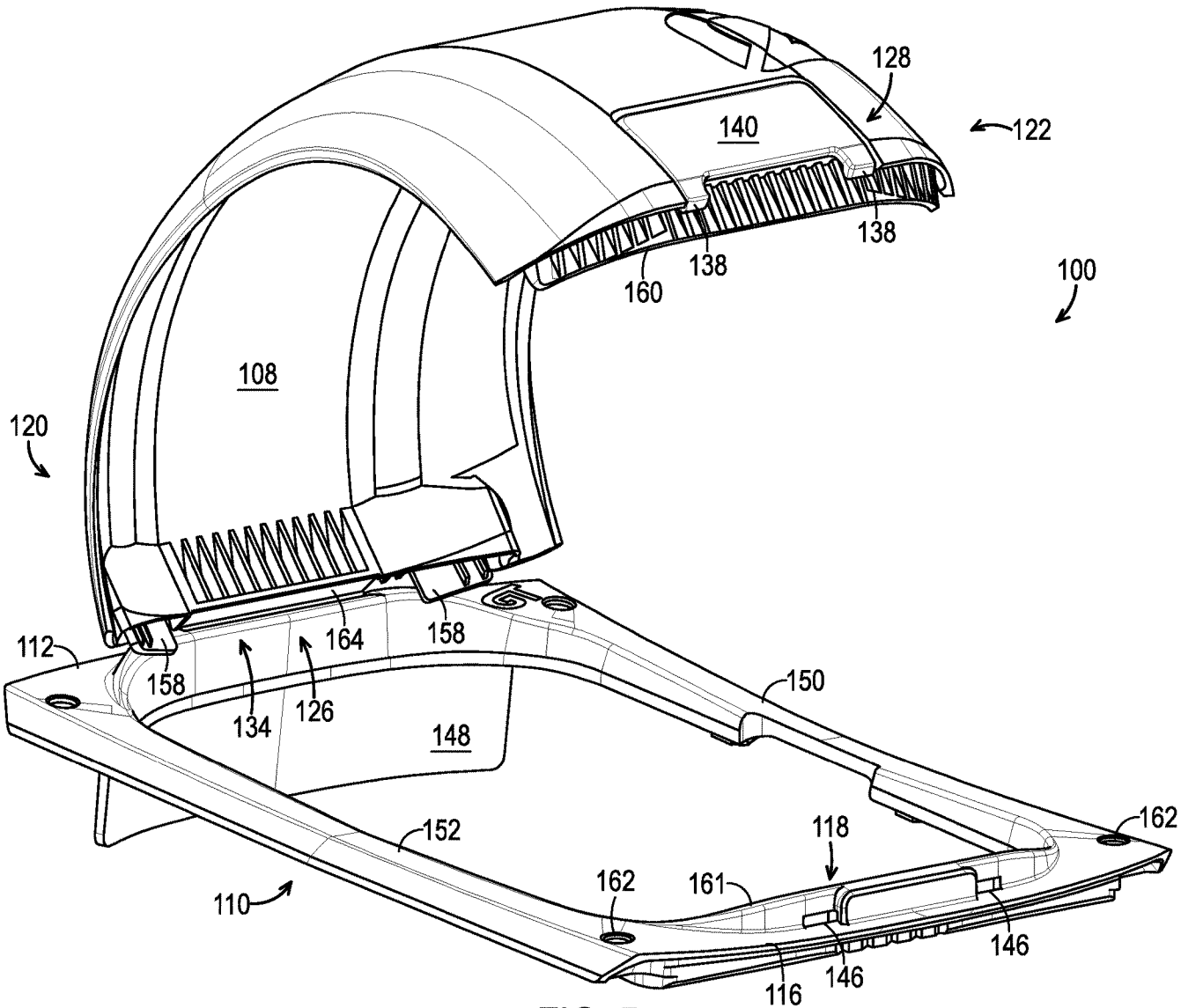
FIG. 5 is an isometric oblique view of the fender assembly of FIG. 2 in an open configuration.
Figure 6:
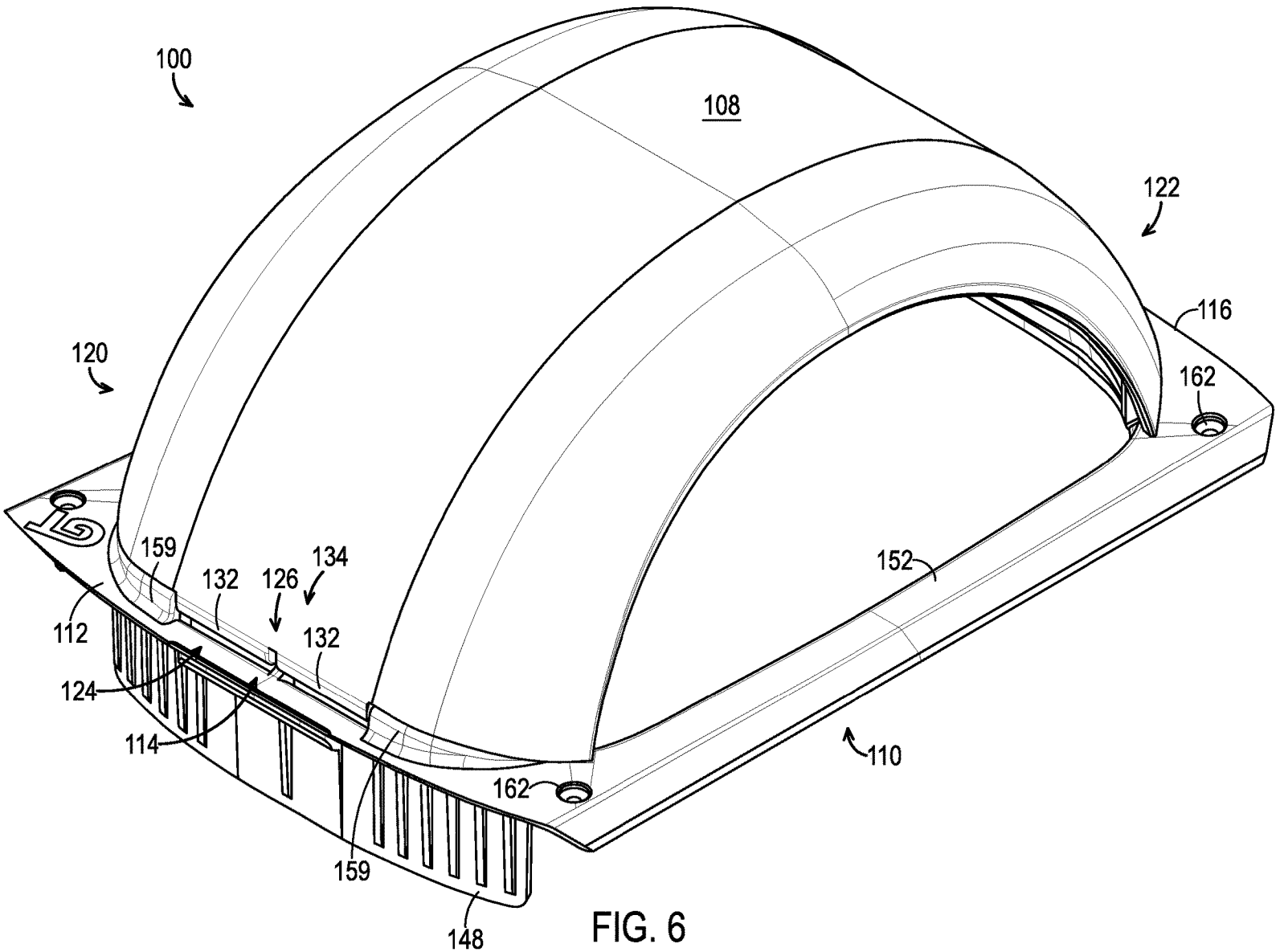
FIG. 6 is another isometric oblique view of the fender assembly of FIG. 2, taken from a pivoting end.
Figure 7:
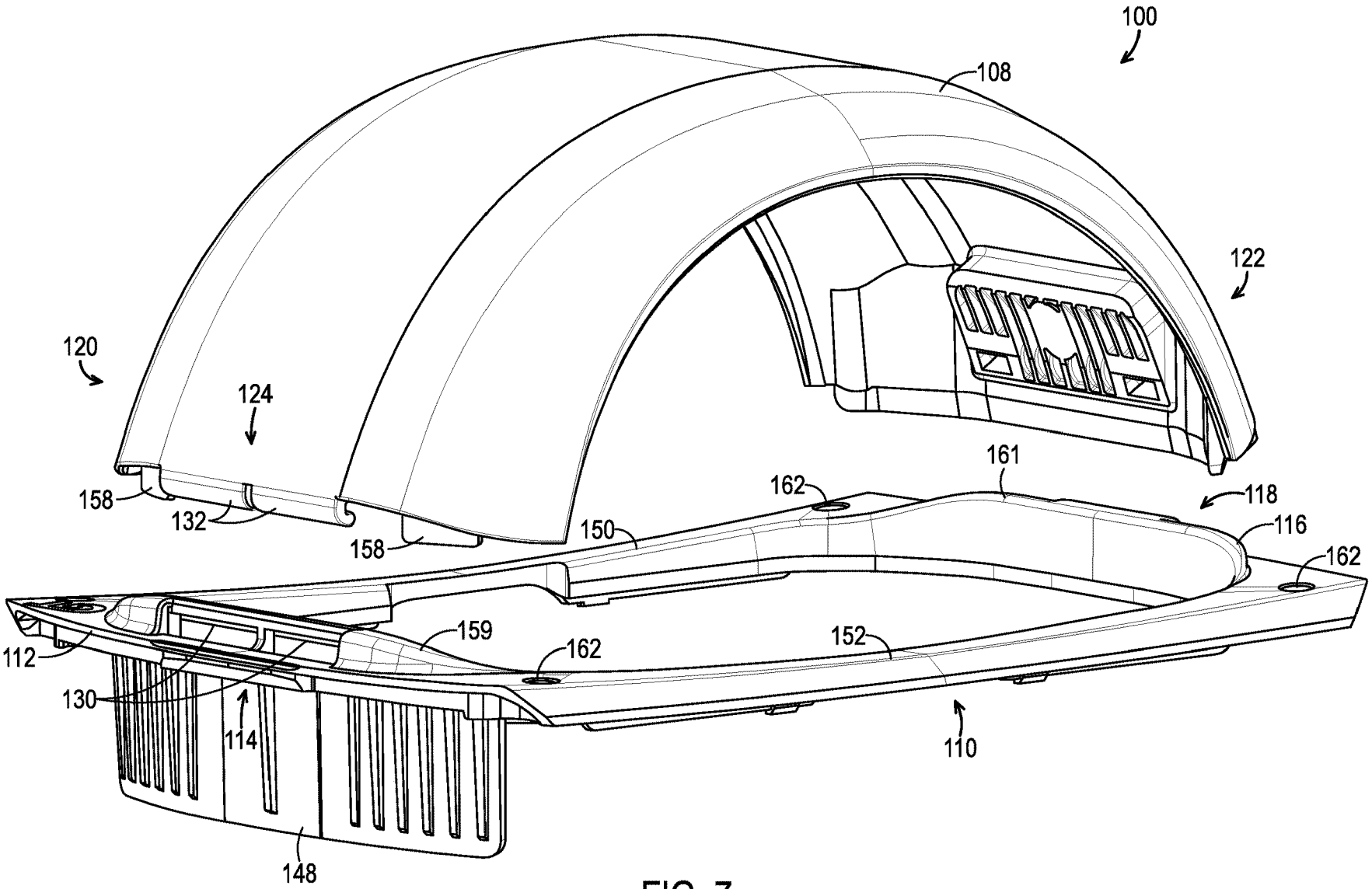
FIG. 7 is an isometric oblique view of the fender assembly of FIG. 2, shown with the fender in a detached configuration.

FIGS. 2-7 are various views of fender assembly 100. FIG. 5 depicts assembly 100 with fender portion 108 having one end raised, and FIG. 7 depicts assembly 100 with the two main portions separated from each other.

With continuing reference to FIGS. 1-7, fender assembly 100 is configured to be installed on vehicle 102 such that the arch of the fender spans from one end of the base frame to the other in a fore-and-aft direction D (with respect to vehicle travel). Accordingly, fender 108 is configured to overarch tire 106 from front to rear. In some examples, fender 108 includes downward-curved lateral edges, such that the fender partially follows the side contours of the wheel.

Frame 110 includes a first leg 112 having a first coupling portion 114 and a second leg 116 including a first latch portion 118. Frame 110 is configured to be coupled to vehicle 102 with first leg 112 and second leg 116 on opposite sides of wheel 106. As best viewed in FIG. 7, first coupling portion 114 and first latch portion 118 may be disposed in and/or formed by raised lips 159, 161 of the frame.

Fender 108 includes an arcuate sheet configured to curve over the wheel, and has a first end 120 and a second end 122. First end 120 has a second coupling portion 124 configured to releasably mate with first coupling portion 114 of frame 110 to form a manually releasable joint 126. Second end 122 has a second latch portion 128 configured to mate with first latch portion 118 of frame 110 to releasably secure the second end to the frame. In some examples, the fender has a circular curvature. In some examples, the fender has an elliptical curvature. Fender 108 curves through a selected angle to provide a desired protection, and may curve through any suitable angle such as at least 90 degrees or such as 180 degrees, e.g., depending on the configuration of the wheel opening.

In some examples, joint 126 is a pivoting joint collectively formed by the first and second coupling portions and the first and second coupling portions may be referred to as first and second hinge portions, respectively. An axis of rotation of joint 126 may be oriented transverse to direction of travel D, i.e., such that the axis is oriented transverse to a longitudinal axis of fender 108 and second end 122 of the fender is configured to be raised up and down relative to base frame 110. (See FIG. 5). In some examples, one of the coupling portions is formed by one or more recesses of the corresponding portion of the fender assembly. In some examples, interaction of the coupling portions is configured to limit rotation of the fender relative to the base frame.

In some examples, first coupling portion 114 includes a first hook and second coupling portion 124 includes a second hook, such that the first and second hooks are configured to hook together. For example, the second hook of fender 108 may be open toward the second end of fender 108 (i.e., the other end), such that the hook of the fender grabs around an outer end of the hook of the base frame relative to the wheel position.

In some examples, including in some examples where the first and second coupling portions comprise hooks, first coupling portion 114 includes a first hinge knuckle 130 and the second coupling portion includes a second hinge knuckle 132, such that the first and second hinge knuckles are configured to collectively form a releasable hinge 134. For example, each of the hinge knuckles may be open, such that the curls or partial tubes forming the knuckles can grab onto each other on one direction but can also be quickly released in an opposite direction (e.g., both directions being generally parallel to direction D). In operation, latching of the other end of the fender to the base frame prevents release of the hinge knuckles from each other, while unlatching permits pivoting and/or release, depending on how the user manipulates the unlatched fender. See the sectional view of FIG. 8.

Figure 8:
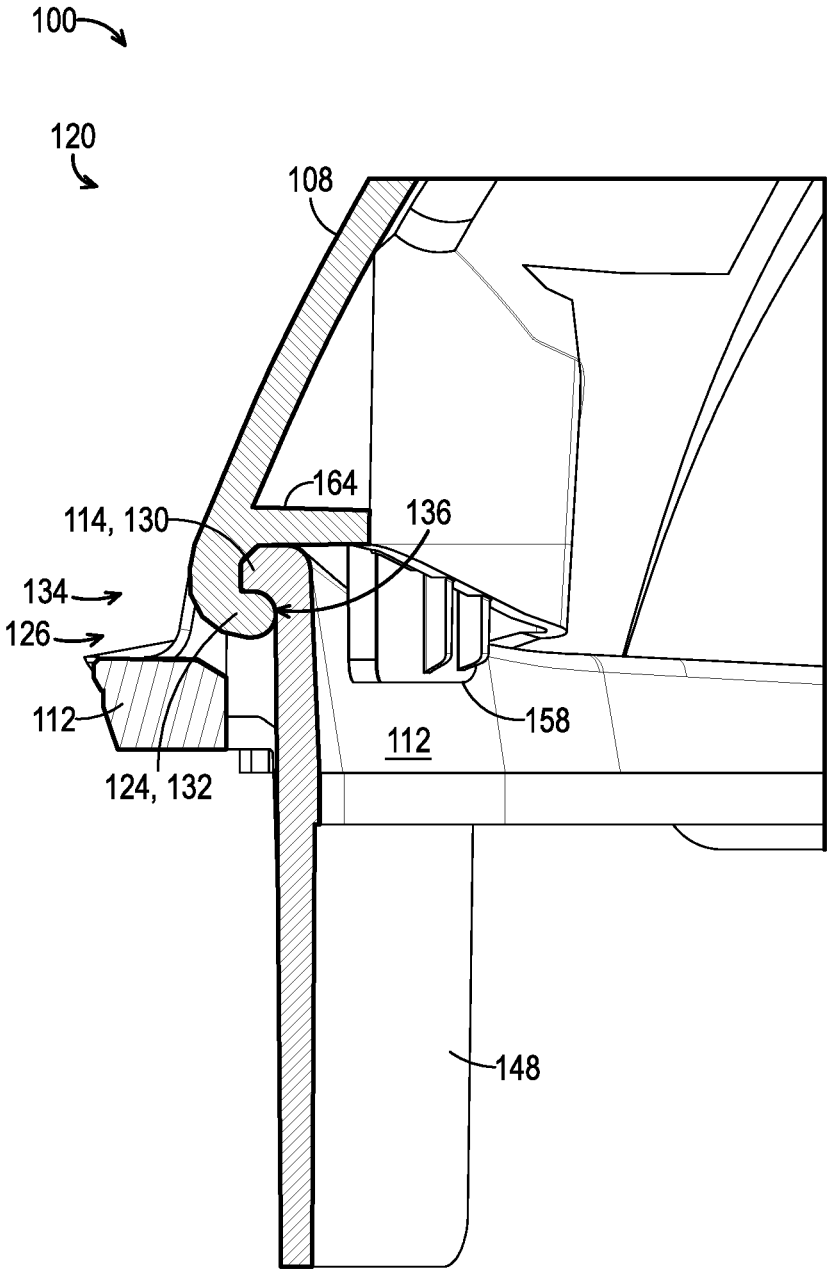
FIG. 8 is a sectional view of the pivoting end of the fender assembly of FIG. 2.

As depicted in FIG. 8 and elsewhere, first hinge knuckle 130 and second hinge knuckle 132 are configured to hook together without the use of a hinge pin. Second hinge knuckle 132 of the fender may have a rounded or radiused end 136 to facilitate rotation of the joint. In some examples, one or both of the hinge knuckles has a rounded end. In some examples, first hinge knuckle 130 is split into a plurality (e.g., two) first knuckle sections spaced apart laterally. In some examples, second hinge knuckle 132 is split into a plurality (e.g., two) of second knuckle sections spaced apart laterally. See FIG. 7.

In some examples, one of the first coupling portion and the second coupling portion includes a hinge knuckle and the other of the first coupling portion and the second coupling portion includes a hinge pin, such that the hinge knuckle and the hinge pin are configured to collectively form a releasable hinge.

With reference to the sectional view of FIG. 8, an illustrative releasable joint 126 is depicted. In this example, hinge knuckle 132 of the fender is depicted in an engaged configuration with hinge knuckle 130 of the base frame. Downward movement of the fender is prevented by an internal ledge or rib 164 of fender 108, which sits atop lip 159 of the base frame when the fender is engaged and latched.

Turning now to the latching end of the assembly, one of the first latch portion 118 and the second latch portion 128 comprises a recess and the other of the first latch portion and the second latch portion comprises a hook. In some examples, second latch portion 128 of the fender comprises a hook 138 and first latch portion 118 of the base frame comprises a recess 146. Recess 146 may include any suitable opening, aperture, recess, or depression in the base frame configured to securely receive hook 138.

Hook 138 comprises an actuator accessible on an exterior of the fender assembly (e.g., on a user-accessible face of second end 122 of the fender). As depicted in the example of FIGS. 2-7 and the sectional view of FIG. 10, hook 138 of the fender comprises a pivotable lever, here in the form of a spring-loaded plate 140 coupled to second end 122 of the fender. Plate 140 includes a pin 142 or other suitable member forming a fulcrum, and is biased by a coil spring 144 toward latching engagement with a recess 146 of base frame 110. Although a coil spring is utilized in this example, any suitable biasing member may be included. As depicted in the example of FIG. 4-5 and elsewhere, hook 138 may include a plurality of hooks (e.g., two hooks), for example extending from a common plate or expanse.

As mentioned above, base frame 110 may in some examples define a ring or an annulus or a fender delete. For example, frame 110 may comprise a third leg 150 and a fourth leg 152, these side legs in combination with the first and second end legs forming a rectangular or generally rectangular annulus. Fender assembly 100 may be coupled to the body of vehicle 102 using multi-use fasteners, such as bolts or screws, secured in apertures 162 of base frame 110. Optionally, an outer, downward-extending ridge or rib 156 and/or tabs 154 of third leg 150 and fourth leg 152 may interface or mate with corresponding features of the vehicle body. Optionally, a mud flap or skirt 148 may extend downward from the first or second leg to cover a corresponding opening or openings in the body of vehicle 102.

In some examples, fender 108 includes one or more flanges or tabs 158 extending generally downward from first end 120 and configured to be disposed on an inner or wheel-facing side of first leg 112 when the fender is coupled to the base frame. Tabs 158 are configured to prevent or resist undesired movement of first end 120 in a longitudinal direction that would result in decoupling of the components of joint 126 and accidental disengagement of the fender from the base frame. For example, if a longitudinal force is applied to the fender, tabs 158 may eventually abut first frame leg 112, arresting movement of the fender before portion 124 becomes disengaged from portion 114. In some examples, fender 108 includes one or more tabs or flanges 160 extending generally downward from second end 122 on a wheel-facing side of second leg 116. Similar to tabs 158, flange 160 is configured to prevent or resist undesired movement of second end 122 in a longitudinal direction that would result in unlatching and accidental disengagement of the fender from the base frame.

Figure 10:
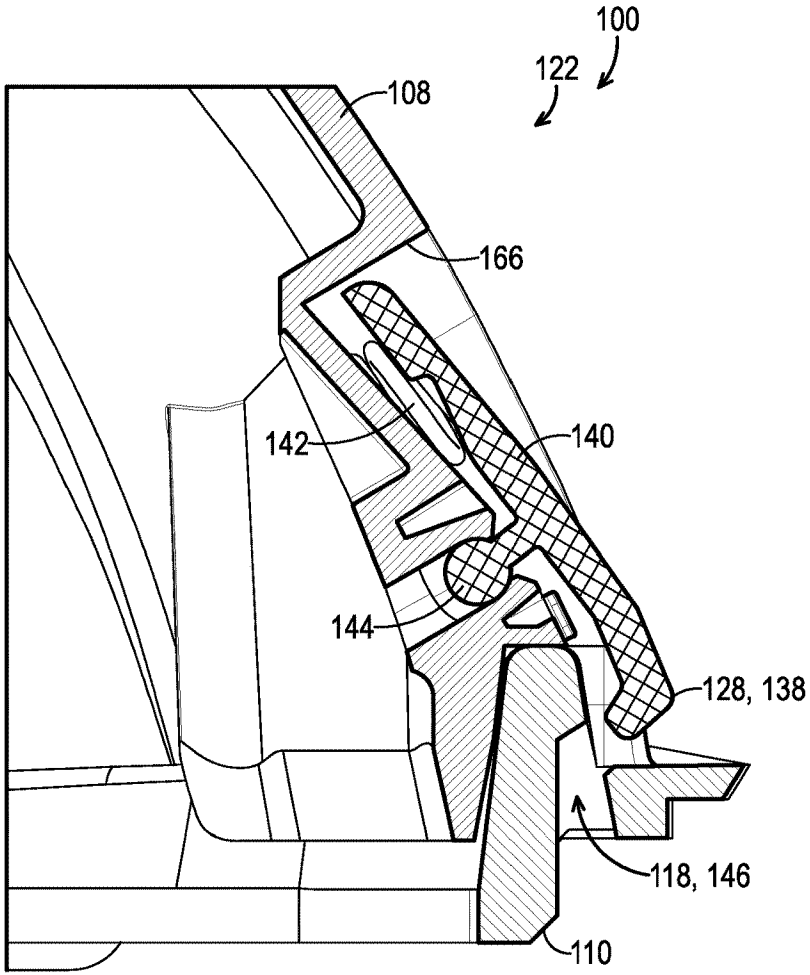
FIG. 10 is a sectional view of the latching end of the fender assembly of FIG. 2, shown in an unlatched position.
Figure 9:
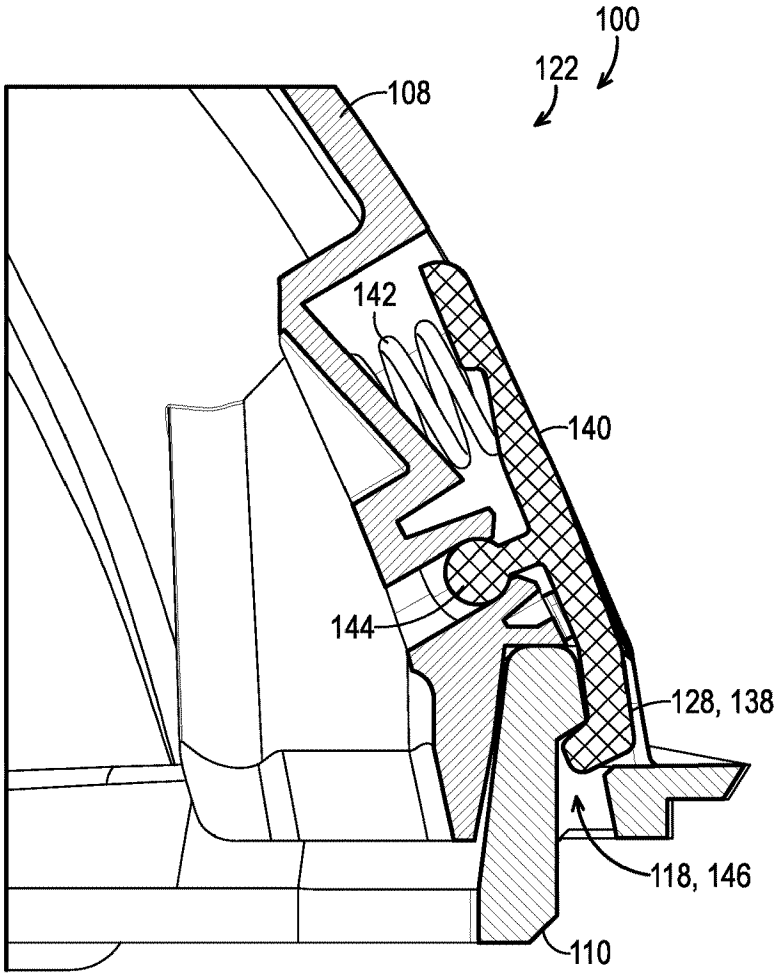
FIG. 9 is a sectional view of the latching end of the fender assembly of FIG. 2, shown in a latched position.

With reference to the sectional views of FIGS. 9 and 10, latching end (i.e., second end 122) of the fender is depicted with actuatable plate 140 in latched (FIG. 9) and unlatching or released (FIG. 10) positions. As shown in FIG. 10, depressing an upper end of plate 140 (e.g., manually, by a user) pivots plate 140 on pin 142 such that hooks 138 disengage from recesses 146 and unlatch the fender from the base frame. Depressing the upper end of plate 140 may also uncover or expose a handle or grip 166 configured to facilitate the application of upward force on the fender to pivot the fender away from the base frame. Pivoting fender 108 downward may automatically latch the second end to the base frame, as hook(s) 138 are pushed aside by the upper end of lip 161 to then pop into recess(es) 146 as urged by spring 144. As depicted in FIG. 9 and elsewhere, an outer face of plate 140 may be flush or substantially flush with an exterior surface of fender 108 when latched.

The enumerated paragraphs below further describe the above systems and devices, as well as other aspects and features of fender assemblies for wheeled vehicles. Each of these paragraphs can be combined with one or more other paragraphs, and/or with disclosure from elsewhere in this application, including the materials incorporated by reference in the Cross-References, in any suitable manner.

Some of the paragraphs below expressly refer to and further limit other paragraphs, providing without limitation examples of some of the suitable combinations.

A1. A fender assembly for a wheeled vehicle, the fender assembly comprising:

a base frame comprising a first leg including a first hinge portion and a second leg including a first latch portion, wherein the base frame is configured to be coupled to a vehicle with the first leg and the second leg on opposite sides of a wheel of the vehicle; and a fender including a first end and a second end, the first end having a second hinge portion configured to releasably mate with the first hinge portion of the frame to form a pivoting joint, the second end comprising a second latch portion configured to mate with the first latch portion of the frame to releasably secure the second end to the frame.

A2. The fender assembly of A1, wherein the first hinge portion comprises a first hinge knuckle and the second hinge portion comprises a second hinge knuckle, such that the first hinge knuckle and the second hinge knuckle are configured to collectively form a releasable hinge.

A3. The fender assembly of A2, wherein the first hinge knuckle and the second hinge knuckle are configured to hook together without the use of a hinge pin.

A4. The fender assembly of A2, wherein the first hinge knuckle is split into two first knuckle sections spaced apart laterally.

A5. The fender assembly of A2, wherein the second hinge knuckle is split into a plurality of second knuckle sections spaced apart laterally.

A6. The fender assembly of A1, wherein one of the first hinge portion and the second hinge portion comprises a hinge knuckle and the other of the first hinge portion and the second hinge portion comprises a hinge pin, such that the hinge knuckle and the hinge pin are configured to collectively form a releasable hinge.

A7. The fender assembly of any one of A1 through A6, wherein one of the first latch portion and the second latch portion comprises a recess and the other of the first latch portion and the second latch portion comprises a hook.

A8. The fender assembly of A7, wherein the hook is biased toward engagement with the recess.

A9. The fender assembly of A8, wherein the hook is biased by a coil spring.

A10. The fender assembly of A8 or A9, wherein the hook comprises a pivotable lever accessible on an exterior of the fender assembly.

A11. The fender assembly of A10, wherein the pivotable lever comprises a spring-loaded plate coupled to the second end of the fender.

A12. The fender assembly of any one of paragraphs A1 through A11, wherein the fender is configured to be separable from base frame without the use of tools.

A13. The fender assembly of any one of paragraphs A1 through A12, wherein the base frame comprises a third leg and a fourth leg, such that the base frame is configured to laterally surround the wheel of the vehicle.

A14. The fender assembly of A13, wherein the base frame comprises a fender delete.

A15. The fender assembly of A13, wherein the base frame comprises a continuous rectangular annulus.

A16. The fender assembly any one of paragraphs A1 through A15, wherein an axis of rotation of the pivoting joint is oriented transverse to a longitudinal axis of the fender, such that the second end of the fender is configured to be raised up and down relative to the base frame.

A17. The fender assembly of any one of paragraphs A1 through A16, the base frame further comprising a mud guard extending from the first leg away from the fender.

A18. The fender assembly of any one of paragraphs A1 through A17, wherein the fender comprises an arcuate sheet curving through at least 90 degrees, e.g., 180 degrees.

A19. The fender assembly of any one of paragraphs A1 through A18, wherein at least a portion of the second end of the fender extends to cover a corresponding portion of a raised lip of the second leg when the fender is latched to the base frame.

A20. The fender assembly of A19, wherein the first latch portion is formed by the raised lip.

B1. A fender assembly for a wheeled vehicle, the fender assembly comprising:

a frame comprising a first leg including a first coupling portion and a second leg including a first latch portion, wherein the frame is configured to be coupled to the vehicle with the first leg and the second leg on opposite sides of a wheel; and a fender including a first end and a second end, the first end having a second coupling portion configured to releasably mate with the first coupling portion of the frame to form a manually releasable joint, the second end comprising a second latch portion configured to mate with the first latch portion of the frame to releasably secure the second end to the frame.

B2. The fender assembly of B1, wherein the first and second coupling portions collectively form a pivoting joint.

B3. The fender assembly of B2, wherein an axis of rotation of the pivoting joint is oriented transverse to a longitudinal axis of the fender, such that the second end of the fender is configured to be raised up and down relative to the base frame.

B4. The fender assembly of B1, wherein the first coupling portion comprises a first hook and the second coupling portion comprises a second hook, such that the first and second hooks are configured to hook together.

B5. The fender assembly of B4, wherein the second hook is open toward the second end of the fender.

B6. The fender assembly of any one of B1 through B3, wherein the first coupling portion comprises a first hinge knuckle and the second coupling portion comprises a second hinge knuckle, such that the first hinge knuckle and the second hinge knuckle are configured to collectively form a releasable hinge.

B7. The fender assembly of B6, wherein the first hinge knuckle and the second hinge knuckle are configured to hook together without the use of a hinge pin.

B8. The fender assembly of B6, wherein the first hinge knuckle is split into a plurality of first knuckle sections spaced apart laterally.

B9. The fender assembly of B6, wherein the second hinge knuckle is split into a plurality of second knuckle sections spaced apart laterally.

B110. The fender assembly of any one of B1 through B3, wherein one of the first coupling portion and the second coupling portion comprises a hinge knuckle and the other of the first coupling portion and the second coupling portion comprises a hinge pin, such that the hinge knuckle and the hinge pin are configured to collectively form a releasable hinge.

B11. The fender assembly of any one of B1 through B10, wherein one of the first latch portion and the second latch portion comprises a recess and the other of the first latch portion and the second latch portion comprises a hook.

B112. The fender assembly of B111, wherein the second latch portion comprises the hook.

B13. The fender assembly of B12, wherein the hook comprises a pivotable lever.

B14. The fender assembly of B13, wherein the pivotable lever comprises a spring-loaded plate coupled to the second end of the fender.

B115. The fender assembly of any one of B111 through B14, wherein the hook is biased toward engagement with the recess.

B116. The fender assembly of any one of B111 through B115, wherein the hook is biased by a coil spring.

B117. The fender assembly of any one of B111 through B116, wherein the hook comprises an actuator accessible on an exterior of the fender assembly.

B18. The fender assembly of any one of paragraphs B1 through B17, wherein the fender is configured to be separable from base frame without the use of tools.

B19. The fender assembly of any one of paragraphs B1 through B18, wherein the base frame comprises a third leg and a fourth leg joining respective ends of the first leg and the second leg, such that the base frame is configured to laterally surround the wheel of the vehicle.

B20. The fender assembly of B19, wherein the base frame comprises a rectangular annulus (e.g., a continuous rectangular annulus).

B21. The fender assembly of any one of B1 through B20, wherein the base frame comprises a fender delete.

B22. The fender assembly of any one of B1 through B21, wherein the base frame comprises a single, continuous ring.

B23. The fender assembly of any one of B1 through B22, wherein the base frame generally defines a plane.

B24. The fender assembly of any one of B1 through B23, the base frame further comprising a mud guard extending from the first leg away from the fender.

B25. The fender assembly of any one of B1 through B24, wherein the fender comprises an arcuate sheet curving through at least 90 degrees, e.g., 180 degrees.

C1. A one-wheeled electric skateboard comprising the fender assembly of any one of paragraphs A1 through B25, wherein:

the skateboard comprises a tiltable body having a central opening and a single wheel mounted to the tiltable body by an axle, such that the single wheel is disposed in the central opening; and wherein the fender assembly is coupled to a top surface of the tiltable body of the skateboard, such that the fender overarches the wheel.

C2. The skateboard of C1, wherein a longitudinal axis of the fender is oriented in a direction of travel of the skateboard.

II. Illustrative Method

This section describes steps of an illustrative method for operating a fender assembly on a vehicle such as a one-wheeled electric skateboard. This method describes steps performed in an illustrative method, and may not recite the complete process or all steps of the method. Although various steps are described below, the steps need not necessarily all be performed, and in some cases may be performed simultaneously or in a different order than the order shown.

A first step includes manually engaging a first end of a fender with a base frame of a fender assembly by forming a releasable pivot joint using respective portions of the fender and the base frame, wherein the base frame is coupled to a vehicle on opposing sides of a wheel.

A second step includes manually latching a second end of the fender to the base frame using a latch formed by respective portions of the fender and the base frame.

In some examples, a third step includes operating the vehicle with the fender attached to the base frame.

In some examples, a fourth step includes unlatching the second end of the fender from the base frame, and pivoting the second end of the fender upward to expose at least a portion of the wheel.

In some examples, a fifth step includes pivoting the second end of the fender downward; and relatching the second end of the fender to the base frame. Alternatively, the method may further include disengaging the first end of the fender from the base frame; and detaching the fender from the base frame.

In some examples, the method includes operating the vehicle while the fender is detached and removed from the base frame.

The enumerated paragraphs below further describe the above method and other aspects and features of fender assemblies for wheeled vehicles. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

D1. A method of operating a fender assembly on a vehicle, the method comprising:

manually engaging a first end of a fender with a base frame of a fender assembly by forming a releasable pivot joint using respective portions of the fender and the base frame, wherein the base frame is coupled to a vehicle on opposing sides of a wheel; and manually latching a second end of the fender to the base frame using a latch formed by respective portions of the fender and the base frame.

D2. The method of D1, further comprising operating the vehicle with the fender attached to the base frame.

D3. The method of D1 or D2, further comprising:

unlatching the second end of the fender from the base frame; and pivoting the second end of the fender upward to expose at least a portion of the wheel.

D4. The method of any one of D1 through D3, further comprising:

pivoting the second end of the fender downward; and relatching the second end of the fender to the base frame.

D5. The method of any one of D1 through D3, further comprising:

disengaging the first end of the fender from the base frame; and detaching the fender from the base frame.

D6. The method of D5, further comprising operating the vehicle while the fender is detached and removed from the base frame.

D7. The method of any one of D1 through D6, wherein the fender and the base frame comprise the fender and the frame or base frame of any one of paragraphs A1 through A20 or B1 through B25.

Advantages, Features, and Benefits

The different embodiments and examples of the fender assemblies described herein provide several advantages over known solutions. For example, illustrative embodiments and examples described herein provide a fender assembly that can be placed into different configurations without the need for tools. For example, a vehicle may be operated with only the fender delete (e.g., base frame) portion installed, or with both the fender delete and the fender installed.

Additionally, and among other benefits, illustrative embodiments and examples described herein facilitate simple inspection of the underlying tire or wheel without fully removing the fender assembly. For example, one end of the fender can be unlatched and pivoted upward to expose the tire. No tools are needed.

Additionally, and among other benefits, illustrative embodiments and examples described herein are configured to provide easy pivoting and/or removal of the fender while also maintaining a stable and secure fender attachment during operation. For example, tabs or flanges may extend downward to prevent longitudinal flexing of the fender that may result in unwanted or unexpected detachment of the fender.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. A fender assembly for a wheeled vehicle, the fender assembly comprising:

a base frame comprising a first leg including a first hinge portion and a second leg including a first latch portion, wherein the base frame is configured to be coupled to a vehicle with the first leg and the second leg on opposite sides of a wheel of the vehicle; and a fender including a first end and a second end, the first end having a second hinge portion configured to releasably mate with the first hinge portion of the frame to form a pivoting joint, the second end comprising a second latch portion configured to mate with the first latch portion of the frame to releasably secure the second end to the frame.

2. The fender assembly of claim 1, wherein the first hinge portion comprises a first hinge knuckle and the second hinge portion comprises a second hinge knuckle, such that the first hinge knuckle and the second hinge knuckle are configured to collectively form a releasable hinge.

3. The fender assembly of claim 1, wherein one of the first latch portion and the second latch portion comprises a recess and the other of the first latch portion and the second latch portion comprises a hook.

4. The fender assembly of claim 3, wherein the hook comprises a pivotable lever accessible on an exterior of the fender assembly.

5. The fender assembly of claim 4, wherein the pivotable lever comprises a spring-loaded plate coupled to the second end of the fender.

6. The fender assembly of claim 1, wherein the fender is configured to be separable from base frame without the use of tools.

7. The fender assembly claim 1, wherein an axis of rotation of the pivoting joint is oriented transverse to a longitudinal axis of the fender, such that the second end of the fender is configured to be raised up and down relative to the base frame.

8. The fender assembly of claim 1, wherein at least a portion of the second end of the fender extends to cover a corresponding portion of a raised lip of the second leg when the fender is latched to the base frame.

9. The fender assembly of claim 8, wherein the first latch portion is formed by the raised lip.

10. A fender assembly for a wheeled vehicle, the fender assembly comprising:

a frame comprising a first leg including a first coupling portion and a second leg including a first latch portion, wherein the frame is configured to be coupled to the vehicle with the first leg and the second leg on opposite sides of a wheel; and a fender including a first end and a second end, the first end having a second coupling portion configured to releasably mate with the first coupling portion of the frame to form a manually releasable joint, the second end comprising a second latch portion configured to mate with the first latch portion of the frame to releasably secure the second end to the frame.

11. The fender assembly of claim 10, wherein the first and second coupling portions collectively form a pivoting joint.

12. The fender assembly of claim 11, wherein an axis of rotation of the pivoting joint is oriented transverse to a longitudinal axis of the fender, such that the second end of the fender is configured to be raised up and down relative to the frame.

13. The fender assembly of claim 10, wherein the first coupling portion comprises a first hinge knuckle and the second coupling portion comprises a second hinge knuckle, such that the first hinge knuckle and the second hinge knuckle are configured to collectively form a releasable hinge.

14. The fender assembly of claim 10, wherein one of the first latch portion and the second latch portion comprises a recess and the other of the first latch portion and the second latch portion comprises a hook.

15. The fender assembly of claim 14, wherein the second latch portion comprises the hook, and the hook comprises a pivotable lever.

16. The fender assembly of claim 15, wherein the pivotable lever comprises a spring-loaded plate coupled to the second end of the fender.

17. The fender assembly of claim 14, wherein the hook comprises an actuator accessible on an exterior of the fender assembly.

18. The fender assembly of claim 10, wherein the fender is configured to be separable from base frame without the use of tools.

19. A one-wheeled electric skateboard comprising the fender assembly of claim 10, wherein:

the skateboard comprises a tiltable body having a central opening and a single wheel mounted to the tiltable body by an axle, such that the single wheel is disposed in the central opening; and wherein the fender assembly is coupled to a top surface of the tiltable body of the skateboard, such that the fender overarches the wheel.

20. The skateboard of claim 19, wherein a longitudinal axis of the fender is oriented in a direction of travel of the skateboard.

* * * * *